United States Patent [19]

Carson

[11] Patent Number: 4,932,373

[45] Date of Patent: Jun. 12, 1990

[54] MOTION CONVERTING MECHANISM

[76] Inventor: Douglas T. Carson, 7220 Francis, Lincoln, Nebr. 68505

[21] Appl. No.: 245,805

[22] Filed: Sep. 19, 1988

[51] Int. Cl.[5] ..... F02B 75/32

[52] U.S. Cl. ..... 123/197 AC; 123/56 BC; 92/136; 74/579 R; 417/534

[58] Field of Search ..... 123/46 B, 56 AC, 56 BC, 123/56 C, 56 R, 61 R, 63, 197 R, 197 AB, 197 AC; 74/31, 32, 591, 579 E, 579 R, 603; 92/136; 417/534

[56] References Cited

U.S. PATENT DOCUMENTS 1,090,647 3/1914 Pitts ..... 123/56 BC
4,658,768 4/1987 Carson ..... 123/197 AC

*Primary Examiner*—Noah P. Kamen
*Attorney, Agent, or Firm*—Vincent L. Carney

[57] ABSTRACT

To reduce space requirements, vibrations and certain stresses in a motion converting mechanism, a rod is constrained to reciprocate within a housing where the rod is attached to the crankshaft by a cylindrical shaped connector that orbits around the crankpin in a direction opposite that of the crankshaft while rotating inside the rod. Through the center portion of each stroke, the connector also interfaces directly with the housing by such means as a cam cam-follower or gearing to eliminate a second degree of freedom at midstroke. The resulting motion defined for the center of the connector and the rod is sinusoidal being twice that of the motion of the crankpin in the axis of reciprocation. The resulting stroke is four times the crankpin offset.

16 Claims, 2 Drawing Sheets

MOTION CONVERTING MECHANISM

BACKGROUND OF THE INVENTION

This invention relates to machines having a reciprocating member that is coupled to a rotatable member.

In one class of such machines, particularly combustion engines, the machine includes a reciprocating piston which drives a crankshaft through a connecting rod. Such engines are subject to vibrations resulting from periodic unbalanced inertia forces of the piston, the connecting rod, and the crankshaft counterweights. Such engine designed to reduce such vibrations and cure other disadvantages is disclosed in U.S. Pat. No. 4,658,768 issued to Douglas T. Carson on Apr. 21, 1987, for ENGINE.

The machines described in this patent include a member confined to reciprocation that is coupled to the crankpin of a rotatable crankshaft by a connector which rotates in a direction opposite to that of the crankshaft with the resulting stroke being four times the crankpin offset. In these machines the reciprocating member is a piston rod connected to at least one piston and coupled through a connector to a crankpin with a resulting stroke that is four times the crankpin offset.

Machines of this nature have two unique disadvantages. One of the disadvantages is that a second degree of freedom may occur at midstroke where the motion of the reciprocating member may be zero instead of twice that of the center of the crankpin in the axis of reciprocation. This occurs when the connector rotates in the same direction as does the crank instead of the opposite direction. A second disadvantage is that as the reciprocating member nears midstroke, the connector loses its ability to transfer forces from the reciprocating member to the crankpin and vice versa. The reciprocating member and the connector may then run ahead or fall behind the crankpin resulting in high side thrust forces and possible damage.

The machine described in the aforementioned patent addresses these difficulties by using an interface between the piston rod and the crank. This arrangement has the disadvantage of being unduly complicated and increasing wear because of the engagement of the interface between two moving parts with respect to the housing.

SUMMARY OF THE INVENTION

Accordingly, it is an object of the invention to provide a novel machine having a reciprocating member coupled to a rotary member.

It is a further object of the invention to provide a machine where the reciprocating member is coupled to the rotary member by a connector to reduce machine vibrations.

It is a still further object of the invention to provide a machine where the reciprocating member is coupled to the rotary member by a connector to reduce machine size.

It is a still further object of the invention to provide a machine where the reciprocating member is coupled to the rotary member by a connector with an interface between the connector and the housing to insure continuity of reciprocating member movement through the center of each stroke.

It is a still further object of the invention to provide a machine where the reciprocating member is coupled to the rotary member by a connector with a gear type interface between the connector and the housing to insure continuity of reciprocating member movement through the center of each stroke.

It is a still further object of the invention to provide a machine where the reciprocating member is coupled to the rotary member by a connector with a cam type interface between the connector and the housing to insure continuity of reciprocating member movement through the center of each stroke.

It is a still further object of the invention to provide reciprocating piston engines, pumps, and compressors with a connector between the reciprocating piston assembly and the crank with a gear type interface between the connector and the housing to insure continuity of piston assembly movement through the center of each stroke.

It is a still further object of the invention to provide reciprocating piston engines, pumps, and compressors with a connector between the reciprocating piston assembly and the crank with a cam type interface between the connector and the housing to insure continuity of piston assembly movement through the center of each stroke.

It is a still further object of the invention to provide reciprocating piston engines, pumps and compressors which are economical in construction.

It is a still further object of the invention to provide a reciprocating engine with a connector between the piston assembly and the crank that increases maximum fuel burn time per revolution for diesel engines.

It is still a further object of the invention to provide a reciprocating piston engine with an improved method of communicating piston side thrust to a unique section of cylinder wall in conjunction with improved lubrication to this surface.

It is still a further object of the invention to provide a reciprocating piston engine in which the crank undergoes less stress in maintaining a reciprocating motion for the pistons.

It is still a further object of the invention to provide a reciprocating piston engine where a primary mechanism is utilized to transfer the larger forces/lower velocities encountered by the piston assembly to the crank and where in addition, an intermittent secondary interface is utilized to transfer the smaller forces/higher velocities encountered by the piston assembly to the crank.

In accordance with the above and further objectives of the invention, a reciprocating member that is confined to reciprocation by a housing is attached to a crankshaft by a rotating connector which receives a crankpin and which rotates in a hole in the reciprocating member. The connector has an offset hole into which the crankpin fits. The hole is offset from the center of the connector by a distance equal to the crank radius.

The center of the connector is restricted by the reciprocating member and the housing to a reciprocating motion. As the crank rotates in one direction, the connector rotates in the other direction with its center reciprocating except at the center of each stroke where the center of the connector can experience either reciprocating motion or a zero motion. To insure continued reciprocation through this point, a control mechanism may be provided which in the preferred embodiment is a cam cam-follower interface inclusive of gear interfaces, cam-slider interfaces, and cam cam-follower interfaces between the connector and the housing. The stroke of the reciprocating member is twice the offset plus twice the crank radius or four times the crank radius.

In one embodiment, the inertia forces of the reciprocating piston assembly are balanced by two counterweighted shafts, one rotating in the same direction as the crankshaft and the other rotating in the opposite direction. The shafts are counterweighted to balance the inertia forces of the piston assembly in its axis of oscillation while balancing each other outside that axis of oscillation.

To lower crank stress and bearing friction, the piston assembly is advantageously constructed with a double acting piston for power strokes in both directions. The piston assembly with one double acting piston oscillates back and forth in a two-stroke cycle governed by the crank.

Most of the deceleration results from the compression of gases as one end of the piston completes the compression stroke. The compressed gases and burning fuel accelerate the assembly in the opposite direction as the power stroke ensues. The same events will occur to the other end of the piston one-half revolution later.

In another embodiment, a four-cycle engine requires two double acting pistons connected on opposite sides of the piston assembly to provide for continuous power strokes in both directions. Again, most of the deceleration results from the compression of gases as one end of one of the pistons completes the compression stroke. The compressed gases and burning fuel accelerate the assembly in the opposite direction as the power stroke ensues. The same events will occur to the other end of that piston or the second piston one-half revolution later.

This engine has several advantages such as: (1) it is economical, particularly in a two-cycle diesel engine since it provides relatively vibration-free power without the expense of a larger number of cylinders and fuel injectors; (2) it provides relatively vibration-free operation; (3) it is relatively simple in construction and is economical; (4) it provides reduced engine size; and (5) it provides a more economical engine due to less continuous crank stress and corresponding friction.

SUMMARY OF THE DRAWINGS

The above noted and other features of the invention will be understood more completely from the following detailed description when considered with reference to the accompanying drawings in which.

DETAILED DESCRIPTION

Figure 1:
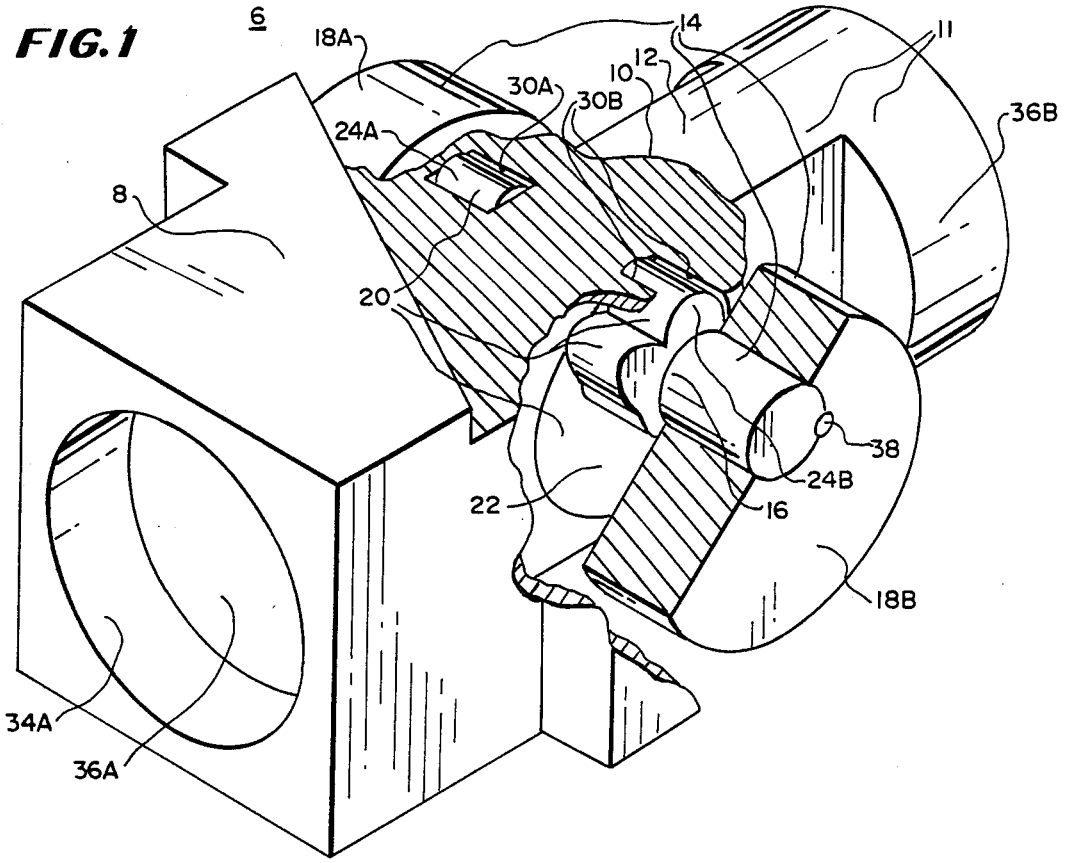
FIG. 1 is a sectioned perspective view of an embodiment of the invention.

In FIG. 1, there is shown a sectioned perspective view of a machine 6 having a housing 8, a reciprocating member referred to as rod assembly 11, a crank assembly 14, and a connector 20. The housing 8 includes: (1) rod constraining surfaces 10 which confine rod 12 in rod assembly 11 to reciprocating motion; and (2) gearing 30A and 30B. Crank assembly 14 includes crankpin 16 and crank journals 18A and 18B. The connector 20 includes cylindrical portion 22 and gearing 24A and 24B.

Rod assembly 11 may: (1) include just rod 12 or also include pistons 36A and 36B and the pistons may be either fastened or integrally formed therewith so as to be of unit construction with rod 12; (2) be shaped as a right angle parallelopiped; (3) include components other than pistons to be reciprocated which components are attached to rod 12; (4) include one or two pistons although two are shown in the embodiment of FIG. 1. Hereafter, rod assembly 11 will be referenced as piston assembly 11 when pistons are attached to rod 12.

In embodiments in which the rod assembly 11 includes pistons 36A and 36B, rod constraining surfaces 10 of housing 8 may be an extension of cylinder wall 34A in which piston 36A reciprocates but may also: (1) be larger in diameter than cylinder wall 34A to allow crankpin 16 or connector 20 to be larger in diameter or to allow crankpin 16 to have a larger radius of crank rotation; (2) of a different shape from the cylinder wall 34A such as for example square in cross-section. However, the rod constraining surfaces 10 in housing 8 and the corresponding surfaces on rod 12 need be such to constrain rod 12 to reciprocating motion and should be such to permit the addition of forced oil lubrication as needed.

Rod constraining surfaces 10 in housing 8 and the corresponding surfaces on rod 12 resist the side thrust forces that are encountered on rod 12. In the preferred embodiment, the curved surfaces of rod 12 receives forced oil lubrication from rod constraining surfaces 10 and is the primary surface resisting side thrust forces on rod assembly 11 or piston assembly 11. The surfaces of rod 12 and the corresponding rod constraining surfaces 10 should be sufficiently removed from the normal heat build up in combustion chambers found in engines to avoid damage. In the event that the rod constraining surfaces 10 of housing 8 are an extension of the cylinder walls 34A in an engine then the fit of piston 36A against cylinder walls 34A would generally be slightly looser than the curved surfaces of rod 12 to allow for thermal expansion.

Crank assembly 14 is constructed with crankpin 16 solid to crank journal 18A. Crank journal 18B is assembled with fasteners to crankpin 16 after the connector 20 is positioned on crankpin 16. Pin 38 is used to properly locate journal 18B with respect to journal 18A and crankpin 16. Various other common methods of crank construction and assembly including unit construction may also be used so long as they are coordinated with the construction and assembly of the connector 20 and the rod assembly 11.

Connector 20: (1) is constrained to reciprocal motion along with rod 12 because it is mounted in a hole in rod 12; (2) includes a cylindrical portion 22 sized to fit into the hole in rod 12 of rod assembly 11, a secondary interface having sides 24A and 24B which are in the form of gearing in the preferred embodiment and a hole in the cylindrical portion sized to receive crankpin 16; and (3) is rotatably attached to crankpin 16 and rotatably attached to rod 12.

With this construction, the connector 20 rotates around crankpin 16 and rotates within the rod 12. The distance from the center of connector 20 to the center of the crankpin 16 is equal to the distance from the center of crankpin 16 to the center of crank 14 hereafter referred to as the crankpin offset or as the radius of crank rotation. The sides 24A and 24B of the secondary interface of connector 20 have centers substantially on the line extending from the center of cylindrical portion 22 of the connector 20 out through the center of the hole receiving crankpin 16.

In another embodiment, the crankpin is a part of the connector and is rotatably attached to the crank in which case it rotates inside the crank. In this embodiment, the distance from the center of rotation of the connector to the center of the crankpin is still the crankpin offset which is the distance from the center of crank rotation to the center of the hole in the crank that receives the crankpin portion of the connector.

Figure 2:
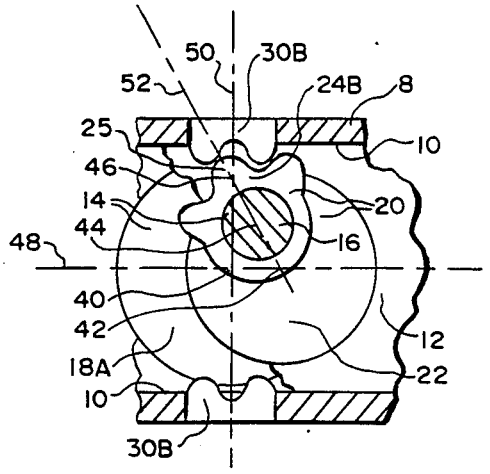
FIG. 2 is a fragmentary, sectional, partly broken away view of the embodiment of FIG. 1.

In FIG. 2, there is shown a simplified, fragmentary, sectional, partly broken away view of the rod assembly 11 about half way between the center of its stroke and the top of its stroke. The axis of crank assembly 14, the axis of crankpin 16, and the axis of the cylindrical portion 22 of connector 20 are shown as points in FIG. 2 and are hereafter referred to as the crank center 40, the crankpin center 44, and the center of connector rotation 42 respectfully. The cylindrical portion 22 of connector 20 has a center of rotation 42 which is confined to reciprocation along line 48 by rod 12 which in turn is confined to reciprocation by rod constraining surfaces 10 of housing 8.

At the top of the stroke, the crank center 40 of crank assembly 14, the crankpin center 44 of crankpin 16, and the center of connector rotation 42 of the cylindrical portion 22 of connector 20 are all substantially on center line 48 hereafter referred to as the axis of reciprocation. At midstroke, the center of connector rotation 42 and the crank center 40 substantially coincide while the crankpin center 44 is substantially on center line 50 which is a line through the crank center 40 and perpendicular to the axis of reciprocation 48.

Since the crank center 40 and the center of connector rotation 42 coincide at midstroke: (1) the distance from the crankpin center 44 to the center of connector rotation 42 is equal to the distance between the crank center 40 to the crankpin center 44 or thus equal to the crankpin offset; and (2) the distance from the crank center 40 to the center of connector rotation 42 at the top of the stroke is substantially twice the crankpin offset and the total stroke is substantially four times the crankpin offset or four times the radius of crank rotation. The basic structure and operation of the machine is similar to that described in U.S. Pat. No. 4,658,768, the disclosure of which is hereby incorporated herein, and a further description of parts of the basic rotary machine is provided in that patent with reference to similar drawings and terminology.

The motion of the crankpin center 44 can be broken down into two components, one component being in a direction of rod reciprocation and the other being perpendicular to the direction of rod reciprocation. The center of connector rotation 42 is confined to motion along the axis of reciprocation 48. Also, the angle between the line connecting crank center 40 to crankpin center 44 and the line connecting the center of connector rotation 42 and crankpin center 44 is equal to substantially twice the angle between the line connecting crankpin center 44 to crank center 40 and line 50 which is perpendicular to the axis of reciprocation 48 and which passes through crank center 40.

Because of this relationship, as the crankpin center 44 rotates clockwise, the center of connector rotation 42 reciprocates on the axis of reciprocation 48 while rotating counterclockwise relative to crankpin center 44. The angular velocity of the connector 20 is equal and opposite the angular velocity of crank 14. The center of connector rotation 42 has an angular velocity relative to crankpin center 44 that is opposite and twice that of the angular velocity of crankpin center 44 relative to crank center 40. Also, the motion and velocity of the center of connector rotation 42 is substantially twice the component of motion and velocity of crankpin center 44 in a direction of rod reciprocation.

The movement and velocity of the center of connector rotation 42 is twice that of the crankpin center 44 in the direction of reciprocation. This relationship is very exacting at the top of the stroke and the bottom of the stroke especially when the crankpin center 44 is approaching the axis of reciprocation 48. However, as the crankpin center 44 approaches midstroke the relationship becomes less defined.

As crankpin center 44 approaches midstroke the angle between the axis of reciprocation 48 and the line connecting crankpin center 44 to crank center 40 approaches 90 degrees and the sine of that angle approaches 1. Since the distance from crankpin center 44 to the center of connector rotation 42 is equal to the distance from crank center 40 to crankpin center 44, the sine of the angle between the axis of reciprocation 48 and the line connecting crankpin center 44 to the center of connector rotation 42 approaches 1. However, the sines of angles between 88 degrees to 92 degrees range from 0.9994 to 1 and are thus approaching 1.

Because of this relationship, the center of connector rotation 42 could easily be several degrees or even more ahead or behind the crankpin center 44 at midstroke. Also, since the set of angles with sines essentially approaching 1 include angles from about 85 degrees to 95 degrees, it follows that the center of connector rotation 42 could run substantially ahead or behind its theoretical position relative to the crankpin center 44 especially if it is subjected to large forces that are in the direction of reciprocation through that portion of midstroke.

The motion and velocity relationship between the crankpin center 44 and the center of connector rotation 42 becomes more vague at exact midstroke when the center of connector rotation 42 coincides with the crank center 40. At this point there is a second degree of freedom where the connector 20 can rotate with the same angular velocity in the same direction as does crank 14 relative to both the crank center 40 and the center of connector rotation 42. The center of connector rotation 42 remains stationary, coinciding with crank center 40. The result is zero reciprocating motion and velocity for the center of connector rotation 42 and for rod assembly 11. Theoretically, the motion of the center of connector rotation 42 is twice that of the crankpin center 44 in the direction of rod reciprocation except at exact midstroke where the two degrees of freedom exist.

The interfaces of this machine address the problem caused by the two degrees of freedom in the novel manner of allowing the reciprocative nature of rod 12 and the rotary nature of crankpin 16 to affect the motion of the center of connector rotation 42 towards the top of the stroke and towards the bottom of the stroke while allowing an additional interface between the connector 20 and the housing 8 to additionally affect the motion through a substantial part of the center of the stroke generally referred to as midstroke. The linkage between the crankpin 16, the connector 20, the rod 12, and rod constraining surfaces 10 is continuous although partially ineffective through midstroke. It is the primary mechanism for converting rotary to reciprocating motion and reciprocating motion to rotary motion for the invention. The additional interface between connector side 24B of the secondary interface and housing side 30B of the secondary interface is a secondary interface that occurs only through a substantial portion of midstroke where the combination of the primary linkage and the secondary interface results in a motion and velocity of the center of connector rotation 42 that is again twice the motion and twice the velocity of the crankpin center 44 in the direction of reciprocation. The secondary interface thus insures this same continued motion through a predetermined portion of midstroke. The novel effect of these two mechanisms results in continuity of motion through the complete stroke for the connector, the rod, and the rod assembly.

The primary mechanism described above maintains the motion and velocity relationship between the center of connector rotation 42 and the crankpin center 44 for all but the center portion of the stroke. The secondary interface between connector side 24B of the secondary interface and housing side 30B of the secondary interface is intermittent and generally engages only through that portion of midstroke on either side of exact midstroke as is necessary to facilitate a reliable mechanism in the real world.

As best shown in FIG. 2, in the preferred embodiment, the housing side 30B of the secondary interface is a cam while the connector side 24B of the secondary interface is a cam follower including principal cam lobe 25. In the preferred embodiment, the housing side 30B of the secondary interface and the connector side 24B of the secondary interface are in the form of gearing. The housing side 30B of the secondary interface: (1) may be solid to housing 8 or be a separate insert that is fastened in place in housing 8; and (2) may be adjustably mounted to allow for machining errors. Although the secondary interface, which includes the connector side 24B of the secondary interface and housing side 30B of the secondary interface, is gearing, they may instead be in the form of a cam cam-follower, a cam slider, or be gearing in nature. When the secondary interface is in the form of a cam camfollower, the housing side 30B of the secondary interface is a cam while the connector side 24B of the secondary interface is a cam follower which includes principal cam lobe 25.

With this structure, the secondary interface is such that housing side 30B of the secondary interface in housing 8 constrains connector side 24B of the secondary interface on connector 20 to a specific motion and velocity that produces a motion and velocity in the center of connector rotation 42 that is twice the motion and velocity of the hole in connector 20 receiving crankpin 16 in the direction of reciprocation. This interface in effect causes the center of connector rotation 42 to reciprocate with a motion and velocity that is twice that of crankpin 16 in the direction of reciprocation. This resulting motion and velocity is the same as the primary linkage and removes the possible second degree of freedom through midstroke.

To better illustrate this secondary interface, line 52 is shown as a line extending from the center of connector rotation 42 out through crankpin center 44. A point 46, hereafter referred to as the connector interface center, is on an extension of line 52 at a location that is substantially twice the distance from the center of connector rotation 42 as is the crankpin center 44. The connector interface center 46 can also be described as that point on line 52 extending out from the center of the connector rotation 42 through the center of the hole receiving the crankpin 16 and at a distance of twice the crankpin offset from the center of the connector rotation 42.

Since the center of connector rotation 42 is substantially twice the distance from line 50 as is crankpin center 44, the connector interface center 46 is on line 50 which is the line passing through crank center 40 perpendicular to the axis of reciprocation. The interface is such that the housing side 30B of the secondary interface constrains the connector side 24B of the secondary interface to a motion that confines the connector interface center 46 to line 50.

Since the distance from the connector interface center 46 to the center of connector rotation 42 is twice the distance from the connector interface center 46 to crankpin center 44 and the hole in the connector receiving the crankpin and also as long as housing side 30B of the secondary interface constrains the connector side 24B of the secondary interface so that the connector interface center 46 has a zero motion and velocity in the direction of reciprocation 48, the center of connector rotation 42 must have a motion and a velocity twice that of the crankpin center 44 in the direction of reciprocation. This resulting motion is the same as that of the primary linkage and its addition through a predetermined portion of midstroke provides continuity of movement to the center of connector rotation 42 and thus to rod 12 and rod assembly 11.

A variety of secondary interfaces may be used to insure the proper motion of the center of connector rotation through midstroke. Half of one such interface is a housing interface that is in the form of a slot in the housing with the walls of the slot being parallel to and equal distance from a plane passing through the crank axis and perpendicular to the axis of reciprocation. The other half of the interface is a connector interface that is in the form of a cylindrical roller mounted to the connector at the location of the connector interface center.

This configuration for a secondary interface guarantees continuity of movement through midstroke as follows. The slot in the housing restricts the center of the cylindrical roller to a zero velocity in the direction of reciprocation. Since the velocity of the center of the cylindrical roller is zero in the direction of reciprocation, and the distance from the center of the roller to the center of connector rotation is twice the distance of the center of the roller to the center of the hole that receives the crankpin, it follows that the resulting motion and velocity of the center of connector rotation in the confined direction of reciprocation is twice that of the crankpin in the direction of reciprocation.

One method has been described to insure continuity through midstroke by using a secondary interface between the connector and the housing walls. This secondary interface can be achieved in a variety of forms. The parallel slots could be used again as part of the housing walls or as inserts while the cylindrical roller could be a non-rolling cylinder or partial cylinder that is solid to the connector. Various cam-cam slider and cam-cam follower interfaces could be used. Likewise, gearing could also be used to achieve a rolling action that would reduce the wear between the surfaces of the connector interface and the housing interface. Part of the cylinder or housing walls could be rack gearing or the rack gearing could be an insert. The gearing on the connector could be similar to a pinion gear. Although gearing is referenced, it would be a special gearing that is not constant velocity gearing. This special gearing would be a subset of cam cam-followers.

The motion imparted by the special gearing would need to be sinusoidal since the position of the center of connector rotation 42 relative to the crank center 40 is defined as twice the crankpin offset times the cosine of the angle between the axis of reciprocation 48 and the line connecting the crank center 40 to the crankpin center 44. The velocity of the center of the connector rotation 42 relative to crank center 40 is defined to be twice the crankpin offset times the angular velocity of the crank 14 times the sine of the same angle.

A secondary interface that constrains the connector interface center to a zero velocity in the direction of reciprocation could have a wide variety of surface profiles for the connector interface and the housing interface. The profiles could range from those generated from straight lines and circles to arcs defined by polynomial equations provided they constrain the connector interface axis to a zero motion and velocity in the direction of reciprocation which would restrict the axis of connector rotation and the reciprocating mechanism to a velocity that is twice the velocity of the crankpin axis in the direction of reciprocation. Any control mechanism may be used including gears, cam sliders, and cam followers that imparts or restrains motion from the housing interface to the connector interface that results in motion for the axis of connector rotation and for the rod that is sinusoidal and where the axis of connector rotation and the rod achieve their maximum velocity at midstroke and where that maximum velocity is substantially twice the orbital velocity of the crankpin axis around the axis of crank rotation.

The profiles of the possible surfaces for the secondary interface could range from cam slider mechanisms with primarily sliding contact between the connector interface and the housing interface to a group of mechanisms where the action between the connector interface and the housing interface is a rolling contact. The action could be involute in nature. Although modified gearing would be a preferred method, the gear profiles should reflect in design and manufacture that the motion and velocity of the center of connector rotation is sinusoidal and not of constant velocity and that the center of connector rotation and the connector interface center are rotating around the crankpin center which through midstroke is moving along an arc rather than a straight line. In reduced form all that is required are connector interface surfaces and housing interface surfaces that interface through midstroke to provide a zero motion to the center of the connector interface. Although these surfaces may be simply made, they may also take on the more complicated profiles to achieve a desired rolling contact to reduce wear.

The profiles of the surfaces of the connector interface and the housing interface where they begin and end their engagement may also be further complicated by sufficient relief to allow for smooth engagement despite manufacturing tolerances and or wear. The surfaces would be relieved so that a smooth engagement would be possible whether the rod is slightly ahead or behind its theoretical position at the point of engagement. The surfaces would then blend into their ideal theoretical shape over a duration of about 5 degrees to 10 degrees of travel. This would allow the rod to make a location and velocity transition from the controlling primary mechanism to the controlling secondary interface and back without encountering impact loading. A somewhat similar situation is encountered by spur gearing as the loads are transferred from tooth to tooth.

The duration of the secondary interface necessary to guard the connector against the second degree of freedom is generally from about 25 degrees to 35 degrees before midstroke to about 25 degrees to 35 degrees after midstroke. Thus, the total duration necessary for the secondary interface is about 50 degrees to 70 degrees when the rod is moving in one direction through midstroke and likewise about 50 degrees to 70 degrees when the rod is moving in the opposite direction through midstroke. However, the duration of the secondary interface may be increased to about twice this. Generally, the duration should not exceed 60 degrees before and after midstroke because of unnecessary expense.

The duration of the secondary interface is dependent on various design considerations beyond just the elimination of the second degree of freedom and expense. Generally, the piston assemblies used in engines, pumps, and compressors will encounter large forces and low velocities at the top of the stroke for single acting pistons and at both ends of the stroke for double acting pistons. Through midstroke, the piston assemblies will encounter smaller forces and higher velocities. The primary interface is generally more capable of transferring large forces to the crank than is the intermittent secondary interface especially at the ends of the stroke. The secondary interface, particularly if gearing in nature, is generally more energy efficient in transferring the smaller forces, especially through midstroke. It is advantageous to design the primary interface strong enough to transfer the large forces encountered at the ends of the stroke. It is also advantageous to design the secondary interface with only that bulk and strength necessary to transfer the smaller forces and higher velocities found through midstroke. The duration of the secondary interface should thus be a balance between the attributes of the two interfaces for each specific design. Obviously, the longer the duration of the secondary interface, the stronger, bulkier, and more expensive the secondary interface must be.

Figure 3:
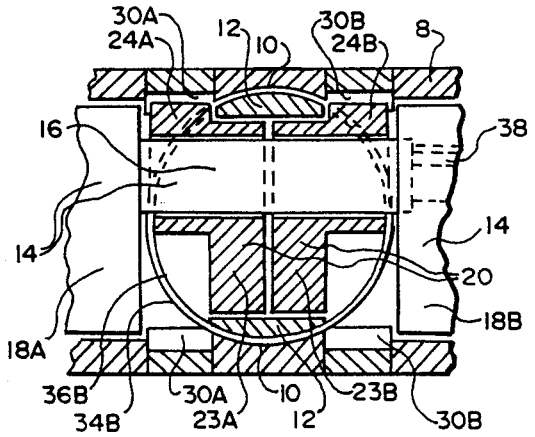
FIG. 3 is a simplified sectional view showing a portion of the embodiment of FIG. 1.

In FIG. 3, there is shown a simplified view of embodiment of FIG. 1 with the rod assembly approaching midstroke. In FIG. 3, rod constraining surfaces 10 are shown as an extension of cylinder 34B that receives piston 36B. The shape of rod 12 is curved so as to correspond with rod constraining surfaces 10. Generally, the diameter of piston 36B would be slightly less than the diameter of rod 12 to allow for the thermal expansion of piston 36B. Although the shape and curve of rod constraining surfaces 10 and rod 12 are shown similar to cylinder 34B and piston 36B, they could be dissimilar or of a different diameter as well.

Crank 14 is shown with crankpin 16 solid to crank journal 18A and fastened to crank journal 18B with location being fixed by locating pin 38. Connector 20 is shown in two portions 23A and 23B that allow for easy assembly onto crankpin 16 and into rod 12. Connector portion 23A would be mounted into rod 12 from one side and connector portion 23B would be installed from the other side. The two portions may then be fastened together so that they rotate as one solid unit or they may be allowed to rotate together separately. The crankpin 16 would be mounted through both portions before being fastened to crank journal 18B.

There are other methods of assembly. For example, the connector 20 may be constructed as a solid unit with rod 12 being separable. Connector 20 would be mounted onto crankpin 16 which would then be fastened to crank journal 18B. The separable parts of rod 12 would be assembled over connector 20 and then attached together by fasteners.

Connector side 24A of the secondary interface is shown engaging one of the housing sides 30A of the secondary interface while connector side 24B of the secondary interface is shown engaging one of the housing sides 30B of the secondary interface.

There are two housing sides 30A of the secondary interface and two housing sides 30B of the secondary interface so that the connector sides 24A and 24B of the secondary interface can engage through both directions of midstroke. Although two sets of sides are shown, only one set is required. Either connector side 24A of the secondary interface with housing sides 30A of the secondary interface or connector side 24B of the secondary interface with housing sides 30B of the secondary interface are necessary provided they are sufficient to bear the loads. Two sets of sides as shown help to reduce loads and better balance the forces. Other possible methods exist.

One method includes having one solid connector with one connector side that would be centrally located on the connector. The housing side would then be located in the center of the housing where it would be more central to the crank journals. The mating surfaces on rod 12 and the rod constraining surfaces 10 would then be located between the housing/connector sides of the secondary interface and each crank journal. Internal clearance would be required on the center portion of the rod to allow for the rotation of the connector side.

Figure 4:
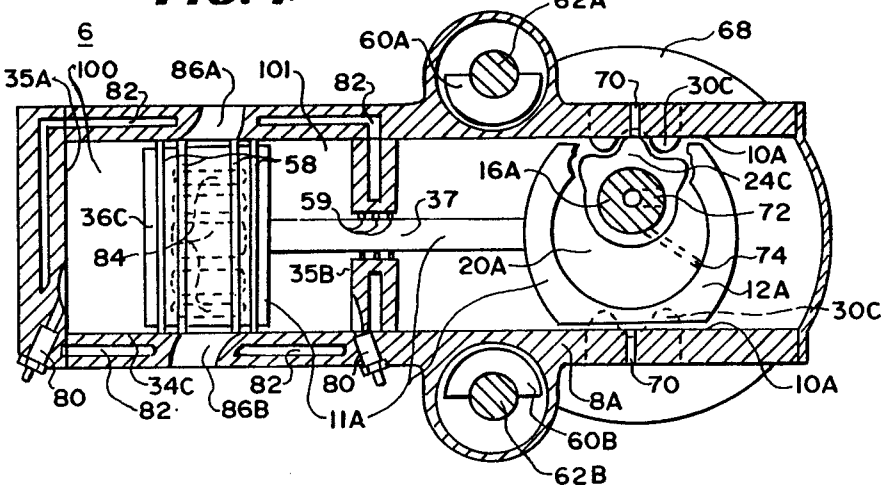
FIG. 4 is a longitudinally-sectioned, elevational view of still another embodiment of the invention.

FIG. 4 is a longitudinally-sectioned, elevational view of an engine which includes piston assembly 11A that has a double-acting piston 36C. Piston assembly 11A includes rod 12A, piston 36C, and a coupling rod 37 to connect the two. Rod 12A is confined to reciprocation by rod constraining surfaces 10A in housing 8A. Crankpin 16A is rotating clockwise through midstroke while connector side 24C of the secondary interface is engaging housing side 30C of the secondary interface to insure that connector 20A continues counterclockwise rotation through midstroke with an angular velocity equal and opposite that of crankpin 16A. The configuration shown for rod 12A is one of unit construction. Rod 12A could consist of two parts that could be assembled onto connector 20A as connecting rods are typically assembled onto crank journals. Connector 20A could also be assembled onto crankpin 16A in a similar fashion so that the crank could be of unit construction as is typical in most automotive engines.

Piston 36C is a double acting piston which includes piston/oil rings 58 on both ends of piston 36C. Piston-/oil rings 59 are also mounted in head 35B. Head 35B may include a raised projection in the direction of piston 36C immediate to piston coupling rod 37 with piston 36C having a corresponding recess. The raised projection would extend out sufficiently from the head 35B to the protect piston coupling rod 37 from heat build up during the high temperatures encountered at the beginning of the combustion stroke. The recess in the piston would be sufficient to allow for clearance between itself and the raised projection of head 35B and to also permit piston 36C to approach head 35B close enough for high compression ratios. Additional rings may be located in the raised projection.

The engine has counterweighted webs 60A and 60B which are mounted on shafts 62A and 62B respectfully. In FIG. 4, the counterweighted webs are shown at midstroke opposing each other in a direction perpendicular to the axis of reciprocation.

Figure 5:
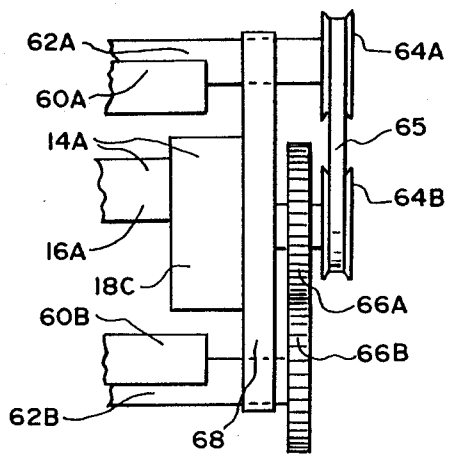
FIG. 5 is a simplified plan view, in section, showing a portion of the embodiment of FIG. 4.

FIG. 5 is a simplified plan view, in section, showing a portion of the embodiment of FIG. 4. Shaft 62A is connected to crank 14A via positive drive pulley 64A, positive drive pulley 64B and positive drive belt 65. Pulleys 64A and 64B have the same number of teeth so as crank 14A rotates clockwise, shaft 62A rotates clockwise with the same angular velocity. Shaft 62B is connected to crank 14A via gears 66A and 66B. Gears 66A and 66B have the same number of teeth so as crank 14A rotates clockwise, shaft 62B rotates counterclockwise with an equal an opposite angular velocity.

As shown in FIG. 4 and FIG. 5, counterweighted webs 60A and 60B are mounted on shafts 62A and 62B respectfully so that as crank 14A rotates clockwise, shaft 62A rotates clockwise and shaft 62B rotates counterclockwise all in a synchronous manner where the inertia forces of counterweighted webs 60A and 60B oppose the inertia forces of the piston assembly 11A and connector 20A in the axis of reciprocation and oppose each other in a direction perpendicular to the axis of reciprocation.

Various combinations of gearing and/or positive drive pulleys and belts can be used besides the one described. Any combination may be used provided shafts 62A and 62B rotate in a synchronous manner with their angular velocities substantially equal and opposite and provided their counterweighted webs 60A and 60B are constructed on shafts 62A and 62B respectfully so that their combined inertia forces oppose the inertia forces of piston assembly 11A and connector 20A in the axis of reciprocation and so that their inertia forces oppose each other in a direction perpendicular to the axis of reciprocation.

FIG. 5 also shows flywheel 68 and portions of crank 14A including crank journal 18C and a portion of crankpin 16A. Not shown are bearings to support shafts 62A, 62B, and crank 14A. Shafts 62A and 62B as crank 14A would be supported by plain bearing as is conventional in most engine design. These bearings would generally receive forced oil lubrication. The shafts may also be mounted by roller bearings, needle bearings, etc.

FIG. 4 includes flywheel 68 on the side of the crank where the gearing drives shafts 62A and 62B. A second flywheel may be mounted on the other end of the crank to further assist in reducing the torsional vibrations. Vibration dampers may also be incorporated.

Oil passages 70 in housing 8A provide lubrication to rod contraining surfaces 10A in housing 8A and to rod 12A to reduce the friction resulting from side thrust forces. Oil passage 72 provides lubrication from the crankpin 16A to the surfaces of crankpin 16A and the corresponding surfaces of connector 20A that are in contact. Oil passages 74 provide lubrication from the crankpin 16A through connector 20A to the surfaces of connector 20A and the corresponding surfaces of rod 12A that are in contact. Oil passages may also be extended through rod 12A to provide lubrication between the surfaces of rod 12A and the corresponding rod constraining surfaces 10A in lieu of oil passages 70. Oil passages 72 and 74 are located so as to supply lubrication in advance to those surfaces that receive the bulk of the forces during the power stroke. The lubrication as supplied to crankpin 16A is supplied by conventional means.

Oil passages may also be extended from rod 12A through coupling rod 37 to piston 36C to provide for the cooling of piston 36C and coupling rod 37. One passage would provide oil to piston 36C, the other would return oil to rod 12A. The oil to cool piston 36C and coupling rod 37 could be provided to rod 12A from oil passages 72 and 74 in crankpin 16A and connector 20A respectfully or else from oil passages 70 in housing 8A.

The engine includes water passages 82 for cooling cylinder walls 34C and heads 35A and 35B. Cooling fins could likewise be used. The engine may also be designed with the piston, the cylinder walls, and the heads made out of ceramic and may require minimal or no cooling.

Fuel injectors 80 are conventional. However, injectors whose timing can easily be advanced such as the solenoid type may be incorporated to improve efficiency at various RPMs especially in two cycle engines where scavenging and fuel burn time is negatively affected by an increased RPM.

The specific engine shown in FIG. 4 is a two cycle diesel with a double-acting piston that results in a stroke every 180 degrees. In this specific design, the double-acting piston 36C is short enough that the exhaust ports 84 and the intake ports 86A and 86B supply air to both combustion chambers 100 and 101 that piston 36C reciprocates within. The length of the piston 36C would be about the length of the stroke less the height of exhaust ports 84. When piston 36C is at the top of its stroke for combustion chamber 100, exhaust ports 84 lets air flow out of combustion chamber 101 while intake ports 86A and 86B let air flow into combustion chamber 101. Likewise, when piston 36C is at the opposite end of the stroke, exhaust ports 84 lets air flow out of combustion chamber 100 while intake ports 86A and 86B let air flow into combustion chamber 100. The engine could also be built with piston 36C sufficiently longer than the stroke so that separate intake ports and separate exhaust ports would serve combustion chambers 100 and 101.

In this specific engine, there are one set of exhaust ports 84 and two sets of intake ports 86A and 86B. The center of the intake ports 86A and 86B are each located about 90 degrees to about 120 degrees from the center of the exhaust ports 84. Air flows in through the intake ports 86A and 86B in a direction that carries the air up from piston 36C towards the top of the combustion chamber and also in a direction towards the cylinder walls opposite exhaust ports 84. This allows the air to move up towards the top of the combustion chamber opposite ports 84. The air then moves over and back down towards the exhaust ports 84. Scavenging efficiency is enhanced over engines using the conventional single sets of intake and exhaust ports with centers 180 degrees apart. Intake ports 86A are constructed to enhance upward flow in combustion chamber 100 while intake ports 86B are constructed to enhance upward flow in combustion chamber 101. If piston 36C is constructed longer than the stroke than both intake ports 86A and 86B could be directed up towards the top of combustion chambers 100 and 101.

Although one specific method of port construction was described, many more conventional methods may be used. One simple conventional method of port construction is to have one set of intake ports and one set of exhaust ports 180 degrees apart. Another conventional method is to have only intake ports and exhaust valves where the exhaust valves would be located at the top of the combustion chamber. Or the engine could have exhaust ports and intake valves. This keeps exhaust gases and fresh air moving in the same direction with less turbulence thus resulting in more efficient scavenging. However, this method which utilizes both valves and ports increases engine size and cost.

Not shown in FIG. 4 is a supercharger to provide a positive air pressure to intake ports 86A and 86B. The supercharger could be any conventional blower or compressor inclusive of roots blowers and screw, gear, and vane compressors.

Figure 6:
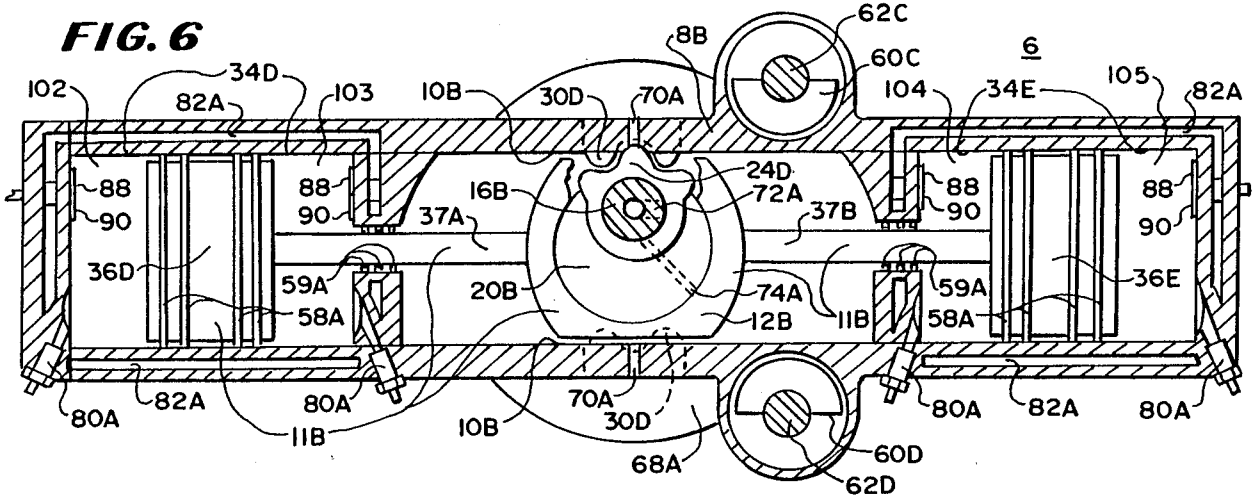
FIG. 6 is a longitudinally-sectioned, elevational view of still another embodiment of the invention.

FIG. 6 is a longitudinally-sectioned, elevational view of an engine which includes piston assembly 11B that has two double-acting pistons 36D and 36E. The construction of this embodiment of the invention is very similar to FIG. 4 except that it utilizes two double-acting pistons 36D and 36E in piston assembly 11B so that a four cycle engine can have two power strokes per revolution. The parts of the embodiment of FIG. 6 that are identical to parts of other embodiments are indicated by the same reference numeral as the identical part in the other embodiments except they may have a different suffix. This configuration allows the piston assembly 11B to be decelerated by compressing gases at the end of each stroke and then to be reaccelerated by the combustion of those gases. Although the two double-acting pistons 36D and 36E are shown on opposite sides of the crank, it is possible to construct the engine with both double-acting pistons and corresponding combustion chambers in line on the same side of the crank.

This engine is shown with intake valves 88 and exhaust valves 90 rather than with ports as described in FIG. 4. Chambers 102, 103, 104 and 105 in FIG. 6 may be used as combustion or expansion chambers in an engine or as pumping chambers in pumps or compressors. This configuration could likewise be used in a two cycle engine to achieve four power strokes every revolution.

The embodiment in FIG. 4 is a basic building block that can be expanded to various other engine possibilities to reduce vibrations some of which would not require counterweighted webs 60A and 60B or corresponding shafts 62A and 62B to aid in balancing them. Also, much of the art of balancing vibrations as taught in U.S. Pat. No. 4,658,768 is also applicable to the vibration balancing of the embodiments of FIG. 1, FIG, 4 and FIG. 6.

Some possible variations to reduce vibrations include combining two of the complete embodiments of FIG. 1, FIG. 4 or FIG. 6 by gearing and/or belting the two cranks together in a synchronous manner so that the two piston assemblies reciprocate back and forth on the same axis of reciprocation with their inertias opposing each other. This method of balancing would eliminate the need of counterweighted webs 60A and 60B as well as corresponding shaft and drive components. This method reflects some of the balancing scheme used in U.S. Pat. No. 4,658,768.

Another balancing scheme would utilize just one crank with two crankpins 180 degrees apart. A piston assembly with a connector that is confined to reciprocate within a housing as earlier described is mounted to each crankpin. Two piston assemblies with connectors may be located on the same side or on opposing sides of the crank with their axes of reciprocation and the crank axis in a common plane. As the crank rotates, the two piston assemblies and connectors will reciprocate with inertia forces opposing each other. The inertia forces would cancel each other but there would be a resulting moment since the reciprocation of the two piston assemblies are on two different axes of reciprocation. Counterweighted webs would not be necessary to balance the opposing inertia forces but would be helpful in balancing the resulting moment. The above balancing scheme can also be extended to a crank with four or more crankpins if desired although this will greatly add to cost.

An engine with four crankpins and four piston assemblies can easily be balanced without the addition of counterweights. The crank could be such that the inertia forces of the inside piston assemblies oppose the inertia forces of two outside piston assemblies which would result in an engine with all the inertia forces and moments of the piston assemblies being balanced without the aid of any counterweighted webs or counterweights on the crank.

Another balancing scheme that is similar utilizes three crankpins where the two outside crankpins are on the same axis and are 180 degrees apart from the axis of the inside crankpin. A piston assembly with a connector that is confined to reciprocate within a housing as earlier described is mounted to the inside crankpin. A second piston assembly with two rods and with two connectors that is also confined to reciprocate within a housing is mounted to the two outside crankpins. The second piston assembly is mounted 180 degrees apart from the first with its axis of reciprocation coinciding with the axis of reciprocation of the first. The inertia forces of the two piston assemblies will oppose each other without creating unbalanced moments.

Additional reduction of vibration can be accomplished by reducing torsional vibrations by adding additional power strokes. One balancing scheme would utilize just one crank with two crankpins 90 degrees apart. A piston assembly with a connector confined to reciprocate within a housing as earlier described is then mounted to each crankpin. The two piston assemblies and connectors may be located on the same side or on opposing sides of the crank. The two axes of reciprocation and the center of the crank would be in a common plane. The inertia forces of the two piston assemblies and the corresponding two connectors can be partially balanced by conventional means using counterweights on the crankshaft or using the method described in FIG. 4 and FIG. 5 where the two shafts 62A and 62B with counterweight webs 60A and 60B are used to balance these inertia forces or a combination. However, since the crankpins are 90 degrees to each other, it follows that the front and back portions of the counterweighted webs for the two crankpins will be located 90 degrees to each other. The engine described can be thought of as basically FIG. 4 with a second FIG. 4 directly behind it or else behind it and rotated 180 degrees and with the second crankpin at 90 degrees to the one shown and the second set of counterweighted webs 90 degrees to the one shown. This two cycle engine would have a power stroke every 90 degrees.

An additional means of utilizing two piston assemblies for a power stroke every 90 degrees in a two cycle engine is to again use the embodiment found in FIG. 4. The engine would be the result of combining two embodiments of FIG. 4, the second directly behind the first and rotated 90 degrees to the first, and with the crank shown having two crankpins where the second is on the same axis as the first or 180 degrees to the first. The resulting strokes would be 90 degrees apart. In this engine, the counterweighted webs as described in FIG. 4 may be used but it would be simpler to counterweight the crank since in this configuration a properly counterweighted crank would balance the inertia forces of both piston assemblies and connectors although it would not balance the moment between the two axes of reciprocation.

The various methods of balancing as described above are also applicable to the embodiment of FIG. 6 for more specific use with four cycle engines. Also, the embodiment found in FIG. 4 with valves instead of ports could be balanced as earlier described where two piston assemblies reciprocate in a common plane to give a four cycle engine a power stroke every 180 degrees. A four cycle engine may be built with a power stroke every 90 degrees by extending the balancing to four crankpins, and four piston assemblies, and four connectors.

The various methods of balancing the vibrational forces as described as well as those methods of balancing vibrational forces found in conventional engines, pumps and compressors may be used with the embodiments described in FIG. 1, FIG. 4 and FIG. 6. The balancing methods described above may likewise be applicable to other existing internal combustion engines, external combustion engines, pumps, and compressors that are either conventional or more specifically for those using connectors with a resulting stroke that is four times the crankpin offset.

The embodiments described above dealt more specifically with diesel engines but are very applicable to gas engines, to many forms of external combustion engines including such engines as the Stirling. The above embodiments are also applicable to pumps, compressors, and to rotary to reciprocating machines in general.

Although a preferred embodiment of the invention has been described with some particularity, many modifications and variations are possible in the preferred embodiment without deviating from the invention. Therefore, it is to be understood that, within the scope of the appended claims, the invention may be practiced other than as specifically described.

What is claimed is:

1. Apparatus comprising:

at least one rod assembly;

said at least one rod assembly including at least one rod;

said at least one rod being adapted to be reciprocated within a housing in a direction of reciprocation;

said housing including a housing interface constant to said housing;

a crank having an axis of crank rotation;

at least one crankpin having a center;

the center of said at least one crankpin having a radius of crank rotation about the axis of crank rotation;

said at least one rod assembly having a rod stroke length of travel and a center of midstroke position halfway between ends of the stroke length of travel;

at least one connector means adapted to be attached to said at least one crankpin;

said at least one connector means being rotatably mounted to said at least one rod;

said connector means including a connector interface;

said connector means having a center of connector rotation;

a resulting distance from the center of rotation of said connector means to the crankpin center being equal to said radius of crank rotation;

said rod stroke length of travel being equal to substantially four times the radius of crank rotation, whereby the connector means rotates with an angular velocity same as but in a direction opposite that of the crank;

interface means between said housing interface and said connector interface for controlling motion through only a predetermined distance portion of midstroke between the housing and the connector means wherein the center of connector rotation and consequently said rod achieve their maximum velocity which is substantially twice the orbital velocity of the center of the crankpin about the axis of crank rotation;

said interface means being positioned to engage at least a during said predetermined distance portion of midstroke to produce a velocity in the center of connector rotation that is substantially twice that of the component velocity of the crankpin center in the direction of reciprocation of the rod through said predetermined portion of midstroke so as to force and maintain continuity of connector means movement during said reciprocation; and said predetermined distance portion of midstroke is that distance necessary to insure continuity of connector means movement of up to about 60 degrees of crank rotation both before and after said center of midstroke.

2. Apparatus according to claim 1 comprising at least one piston assembly and at least one cylinder;

said piston assembly including at least one rod and at least one piston;

said at least one cylinder having walls in which said at least one piston reciprocates therein forming at least one chamber.

3. Apparatus according to either of claims 1 or 2 in which said interface means is a cam camfollower.

4. Apparatus according to claim 3 in which:

said cam cam-follower interface means is gearing;

said gearing imparts motion from said housing through said connector means to said center of connector rotation of said connector means that is sinusoidal.

5. Apparatus according to either of claims 1 or 2 in which:

said housing interface is housing gearing and said connector interface is connector gearing;

said housing gearing confines the connector gearing to a motion that produces a velocity for the center of connector rotation twice that of the crankpin center in the direction of rod reciprocation.

6. Apparatus according to either of claims 1 or 2 in which:

said connector interface has a center on a line through the center of connector rotation out through the crankpin center and a distance substantially the radius of crank rotation from the crankpin and substantially twice the radius of crank rotation from the center of connector rotation;

said housing interface confines said center of said connector interface to substantially a zero motion and a zero velocity in the direction of rod reciprocation.

7. Apparatus according to either of claims 1 or 2 in which:

the linkage between said crankpin, said connector means, said rod, and surfaces of said housing is continuous and is the primary mechanism for converting rotary to reciprocating motion and reciprocating motion to rotary motion;

the interface between said connector interface and said housing interface is an intermittent secondary interface that occurs only through a substantial portion of midstroke;

said primary mechanism transfers the larger forces and lower velocities encountered by said rod assembly to said crank at the ends of the stroke; and said intermittent secondary interface combines with said primary mechanism to transfer the smaller forces and higher velocities encountered by said rod assembly to said crank through midstroke.

8. Apparatus according to claim 2 in which:

at least a portion of said rod substantially conforms to the cylinder walls in which said rod reciprocates in shape and dimensions perpendicular to the direction of motion;

said connector means being rotatably mounted centrally to said rod;

side thrust forces between said piston assembly and said cylinder walls are encountered on the surfaces of said rod near said connector means and removed from said at least one chamber; and forced oil lubrication lubricates said surfaces.

9. Apparatus according to claim 2 in which:

forced oil lubrication is provided to said crank;

said forced oil lubrication is channeled through said crank and through said crankpin and lubricates contacting surfaces between said crankpin and said connector means; and oil passages in said connector means allow said forced oil lubrication to flow from said crankpin through said connector means to lubricate contacting surfaces between said connector means and said at least one rod.

10. Apparatus according to claim 2 in which said at least one chamber is a combustion chamber as is common to internal combustion engines.

11. Apparatus according to claim 10 in which:

said at least one combustion chamber has one set of exhaust ports and two sets of intake ports;

said intake ports direct air towards the top of said combustion chamber and to the side of said top of the combustion chamber opposite said exhaust ports.

12. Apparatus according to claim 2 in which said at least one chamber is an expansion chamber as is common to external combustion engines.

13. Apparatus comprising:

at least one rod assembly;

said at least one rod assembly including at least one rod;

said at least one rod being adapted to be reciprocated within a housing in a direction of reciprocation;

said housing including a housing interface constant to said housing;

a crank having an axis of crank rotation;

at least one crankpin having a center;

the center of said at least one crankpin having a radius of crank rotation about the axis of crank rotation;

said at least one rod assembly having a rod stroke length of travel and a center of midstroke positioned halfway between ends of the stroke length of travel;

at least one connector means adapted to be attached to said at least one crankpin;

said at least one connector means being rotatably mounted to said at least one rod;

said at least one connector means including a connector interface;

said at least one connector means having a center of connector rotation;

a resulting distance from the center of rotation of said at least one connector means to the center of said at least one crankpin being equal to said radius of crank rotation;

said rod stroke length of travel being equal to substantially four times the radius of crank rotation, whereby said at least one connector means rotates with an angular velocity same as but in a direction opposite that of the crank;

interface means between said housing interface and said connector interface for controlling motion through only a predetermined distance portion of midstroke between the housing and the connector means wherein the center of connector rotation and consequently said at least one rod achieve their maximum velocity which is substantially twice the orbital velocity of the center of said at least one crankpin about the axis of crank rotation;

said interface means being positioned to engage during said predetermined distance portion of midstroke to produce a velocity in the center of the connector rotation that is substantially twice that of the component velocity of the center of said at least one crankpin in the direction of reciprocation of said at least one rod through said predetermined distance portion of midstroke so as to force and maintain continuity of said at least one connector means movement during said reciprocation;

said predetermined distance portion of midstroke is that distance necessary to insure continuity of said at least one connector means movement of up to about 60 degrees of crank rotation both before and after said center of midstroke;

at least one piston assembly and at least one cylinder;

said piston assembly including at least one rod and at least one piston;

said at least one cylinder having walls in which said at least one piston reciprocates therein forming at least one chamber;

said crank drives a first shaft at the same angular velocity and in a direction the same as said crank;

said crank drives a second shaft at the same angular velocity and in a direction opposite said crank;

said first shaft has counterweighted webs to reduce vibrations;

said second shaft has counterweighted webs to reduce vibrations;

said counterweighted webs on said first shaft and said counterweighted webs on said second shaft oppose inertia forces of said at least one piston assembly and said at least one connector means in the axis of said at least one piston assembly reciprocation; and said counterweighted webs on said first shaft oppose the inertia forces of said counterweighted webs on said second shaft in a direction transverse to the axis of said at least one piston assembly reciprocation.

14. Apparatus comprising:

at least one rod assembly;

said at least one rod assembly including at least one rod;

said at least one rod being adapted to be reciprocated within a housing in a direction of reciprocation;

said housing including a housing interface constant to said housing;

a crank having an axis of crank rotation;

at least one crankpin having a center;

the center of said at least one crankpin having a radius of crank rotation about the axis of crank rotation;

said at least one rod assembly having a rod stroke length of travel and a center of midstroke positioned halfway between ends of the stroke length of travel;

at least one connector means adapted to be attached to said at least one crankpin;

said at least one connector means being rotatably mounted to said at least one rod;

said at least one connector means including a connector interface;

said at least one connector means having a center of connector rotation;

a resulting distance from the center of rotation of said at least one connector means to the center of said at least one crankpin being equal to said radius of crank rotation;

said rod stroke length of travel being equal to substantially four times the radius of crank rotation, whereby said at least one connector means rotates with an angular velocity same as but in a direction opposite that of the crank;

interface means between said housing interface and said connector interface for controlling motion through only a predetermined distance portion of midstroke between the housing and the connector means wherein the center of connector rotation and consequently said at least one rod achieve their maximum velocity which is substantially twice the orbital velocity of the center of said at least one crankpin about the axis of crank rotation;

said interface means being position to engage during said predetermined distance portion of midstroke to produce a velocity in the center of connector rotation that is substantially twice that of the component velocity of the center of said at least one crankpin in the direction of reciprocation of said at least one rod through said predetermined distance portion of midstroke so as to force and maintain continuity of said at least one connector means movement during said reciprocation;

said predetermined distance portion of midstroke is that distance necessary to insure continuity of said at least one connector means movement of up to about 60 degrees of crank rotation both before and after said center midstroke;

at least one piston assembly and at least one cylinder;

said piston assembly incuding at least one rod and at least one piston;

said at least one cylinder having walls in which said at least one piston reciprocates therein forming at least one chamber;

said at least one chamber being a pumping chamber.

15. Apparatus according to claim 14 in which said pumping chamber is a fluid pump.

16. Apparatus according to claim 14 in which said pumping chamber is a compressor pump.

* * * * *